United States Patent [19]

Kallmes

[11] Patent Number: 4,657,635

[45] Date of Patent: Apr. 14, 1987

[54] METHOD AND APPARATUS FOR THE DEFLOCCULATION OF STOCK

[75] Inventor: Otto J. Kallmes, Marblehead, Mass.

[73] Assignee: M/K Systems, Danvers, Mass.

[21] Appl. No.: 734,114

[22] Filed: May 15, 1985

[51] Int. Cl.[4] ..... D21F 1/00

[52] U.S. Cl. ..... 162/208; 162/209; 162/211; 162/308; 162/310; 162/348; 162/352; 162/353

[58] Field of Search ..... 162/208, 209, 310, 352, 162/210, 211, 308, 348, 353, 354

[56] References Cited

U.S. PATENT DOCUMENTS

| | | | |
|---|---|---|---|
| 1,563,095 | 11/1925 | Lewthwaite | 162/297 |
| 1,989,435 | 1/1935 | Wallquist | 162/310 |
| 2,054,630 | 9/1936 | Hurrey | 162/202 |
| 3,989,085 | 11/1976 | Crosby | 162/310 |
| 4,152,202 | 5/1979 | DeLigt | 162/310 |
| 4,420,370 | 12/1983 | Saad | 162/209 |

FOREIGN PATENT DOCUMENTS

| | | | |
|---|---|---|---|
| 78406 | 5/1983 | European Pat. Off. | 162/208 |

OTHER PUBLICATIONS

O. J. Kallmes & W. Kufferath; "Optimisation of Sheet Formation on Fourdrinier Machines"; 1981; Das Papier 10A.

O. J. Kallmes & B. A. Thorp; "New Redispersion System Improves Formation on the Fourdrinier"; 12/83; Tappi Journal; pp. 54–57.

O. J. Kallmes & M. Perez; "Minimizing Flocculation on the Fourdrinier by the CD Shear Forces of Repetitive Ridges"; 11/82; Tappi Journal; pp. 67–70.

*Primary Examiner*—Peter Chin

*Attorney, Agent, or Firm*—Witherspoon & Hargest

[57] ABSTRACT

A papermaking machine including a non-dewatering forming board comprising a plurality of contiguous blades and a plurality of shower nozzles for showering stock carried by a forming medium over the forming board with a plurality of needle jets of water, each needle jet of water extending in a downstream direction, forming a small acute angle with the stock, and being in close proximity with the stock so that the needle jets of water impinge upon the stock as continuous streams.

14 Claims, 3 Drawing Figures

METHOD AND APPARATUS FOR THE DEFLOCCULATION OF STOCK

BACKGROUND OF THE INVENTION

1. Field of the Invention

The present invention is related to a papermaking machine of the type wherein a plurality of dewatering elements remove water from stock which has been deposited on a forming medium from a slice of a headbox. The machine includes a non-dewatering section in the form of a forming board positioned between the slice and the dewatering elements and a shower apparatus for showering the stock with a plurality of needle jets of water. The needle jets extend in a downstream direction, form a small acute angle with the stock, and are in close proximity with the stock so that the needle jets of water gently impinge upon the stock as continuous streams at a position where the stock is carried over the forming board by the forming medium.

2. Description of the Prior Art

In the typical Fourdrinier papermaking machine, an aqueous suspension of fibers, called the "stock" is flowed from a headbox slice onto a traveling Fourdrinier wire or medium, generally a woven belt of wire and/or synthetic material, to form a continuous sheet of paper or paper-like material. In this connection, the expression "paper or paper-like material" is used in a broad or generic sense and is intended to include such items as paper, kraft, board, pulp sheets and non-woven sheet-like structures. As the stock travels along on the Fourdrinier wire, formation of a paper web occurs, as much of the water content of the stock is removed by draining. Water removal is enhanced by the use of such well-known devices as hydrofoils, table rolls and/or suction devices.

One of the problems incurred in the production of paper is that the physical characteristics of the paper web being formed generally reflect both the non-uniformities of the flow such as streaks and pulsations, and the degree of reflocculation of the stock after it has been deposited from the headbox slice onto the forming medium. Generally, the more non-uniform the flow and the greater the degree of reflocculation, the greater the tendency for the paper web being formed to have various known undesirable features. In known prior art apparatus, the stock is deposited from the slice of the headbox onto the surface of a forming medium which is travelling in the machine direction which is the direction from the headbox to the couch roll. The portion of the forming medium where the stock is so deposited is travelling over a forming board. It is known that the rate of sheet formation and of reflocculation at this position are excessively high. It is desirable to prevent sheet formation from the flow containing these flow non-uniformities and redisperse the reflocculated stock at this position prior to the initiation of sheet formation.

Efforts have been made to reduce web imperfections resulting from such flow non-uniformities and reflocculation of headbox discharge, a problem which has been especially bothersome since the advent of high speed papermaking machines which may operate above about 2000 feet per minute. In early slower Fourdrinier machines, stock was deposited onto a flexible rubber apron which prevented dewatering and sheet formation for a short distance down the forming section of the papermaking machine measured in the machine direction. In addition to an apron, early slow speed Fourdrinier machines had a shake which provided cross machine direction shear throughout the forming process, the effect of which was to disperse the stock. As machine speeds increased, the effectiveness of the shake declined. Recently, attempts have been made at introducing effective shear in high speed applications by means of what is known in the art as the serrated slice. However, problems have been incurred due to the flow non-uniformities of the headbox discharge in that the serrated slice greatly amplifies such non-uniformities. Depending upon the magnitude of the flow disturbances and the machine speed, the stock may jump, spout, roostertail or fly in the form of a spray down the papermaking machine table, undesirable occurences which are well understood by those skilled in the art.

Efforts have also been made to control the characteristics of the paper web by allowing the stock deposited upon the forming medium to "run" for a distance in the absence of dewatering and formation and to subsequently subject the stock to showering. In this manner, undesirable variations in the headbox discharge are first allowed to dissipate, and then an effort is made to redisperse the stock by means of showering. It is believed that a primary objective of such showering should be to provide a uniform flow pattern in the dissipated stock and that such pattern should be in the form of continuous closely spaced ridges which can be collapsed and regenerated in a known manner to overcome reflocculation. However, in known prior art paper-making applications the result of such showering has been to cause an undesirable degree of stock jump.

It is further believed that heretofore the creation of such stock jump has generally resulted from the type of shower used and the more or less haphazard positioning of the shower. For example, typical showers in use today in papermaking facilities are almost invariably a round pipe which delivers water from closely spaced holes drilled in the pipe rather than from nozzles. Generally, the pipes are located at a considerable height above the stock usually of the order of one to two feet. The effect is to cause the stock to be impinged by individual drops rather than continuous needle-like jets. The pipes are usually located wherever it is convenient to do so. For example, it is not at all uncommon to find shower pipes hanging from a catwalk or some other pre-existing structure. Generally, the flow of the shower water is vertically downward onto the stock, heretofore there having been no known attempt to locate the shower apparatus or orient the shower spray in such a manner as to cause the formation of uniform continuous closely spaced ridges useful in preventing reflocculation.

It is highly desirable to provide a shower apparatus which directs needle-like jets of water gently upon the stock as continuous streams at a position where the stock is carried over the forming board by the forming medium. It is also desirable to provide apparatus for deflocculating stock prior to the dewatering process. It is further desired to provide a uniform flow pattern in stock which has been dissipated upon a forming board and to cause such pattern to be in the form of continuous ridges which extend in the machine direction and are closely spaced in the cross machine direction. It is also desirable to provide a shower apparatus for deflocculating stock in the absence of any appreciable stock jump even in instances where the headbox discharge is non-uniform.

SUMMARY OF THE INVENTION

This invention achieves these and other results by providing an improvement to a papermaking machine including an endless forming medium travelling in a machine direction carrying stock deposited on one surface thereof from a slice of a headbox and including a plurality of dewatering elements downstream of the slice. The improvement includes providing a non-dewatering forming board comprising a first blade and at least one other contiguous succeeding blade extending in a cross machine direction adjacent a second surface of the forming medium opposite the one surface. Each of the contiguous succeeding blades is downstream of the first blade. The forming board is positioned between the slice and the dewatering elements. Means are also provided extending in a cross machine direction adjacent the one surface of the forming medium for showering the stock with a plurality of needle jets of water spaced along the showering means in the cross machine direction. Each of the needle jets of water extend in a downstream direction, form a small acute angle with the stock, and are in close proximity with the stock so that the needle jets of water impinge upon the stock as continuous streams at a position where the stock is carried over the forming board by the forming medium.

A method is also provided for making paper on a papermaking machine including an endless forming medium travelling in a machine direction. The method includes depositing stock from a headbox through a slice and onto the forming medium where the forming medium travels over a non-dewatering forming board and showering the stock with a plurality of needle jets of water spaced in the cross machine direction. The needle jets of water extend in a downstream direction, form an acute angle with the stock and are in close proximity with the stock so that the needle jets of water impinge upon the stock as continuous streams at a position where the stock is carried over the forming board by the forming medium.

DESCRIPTION OF THE PREFERRED EMBODIMENT

Figure 1:
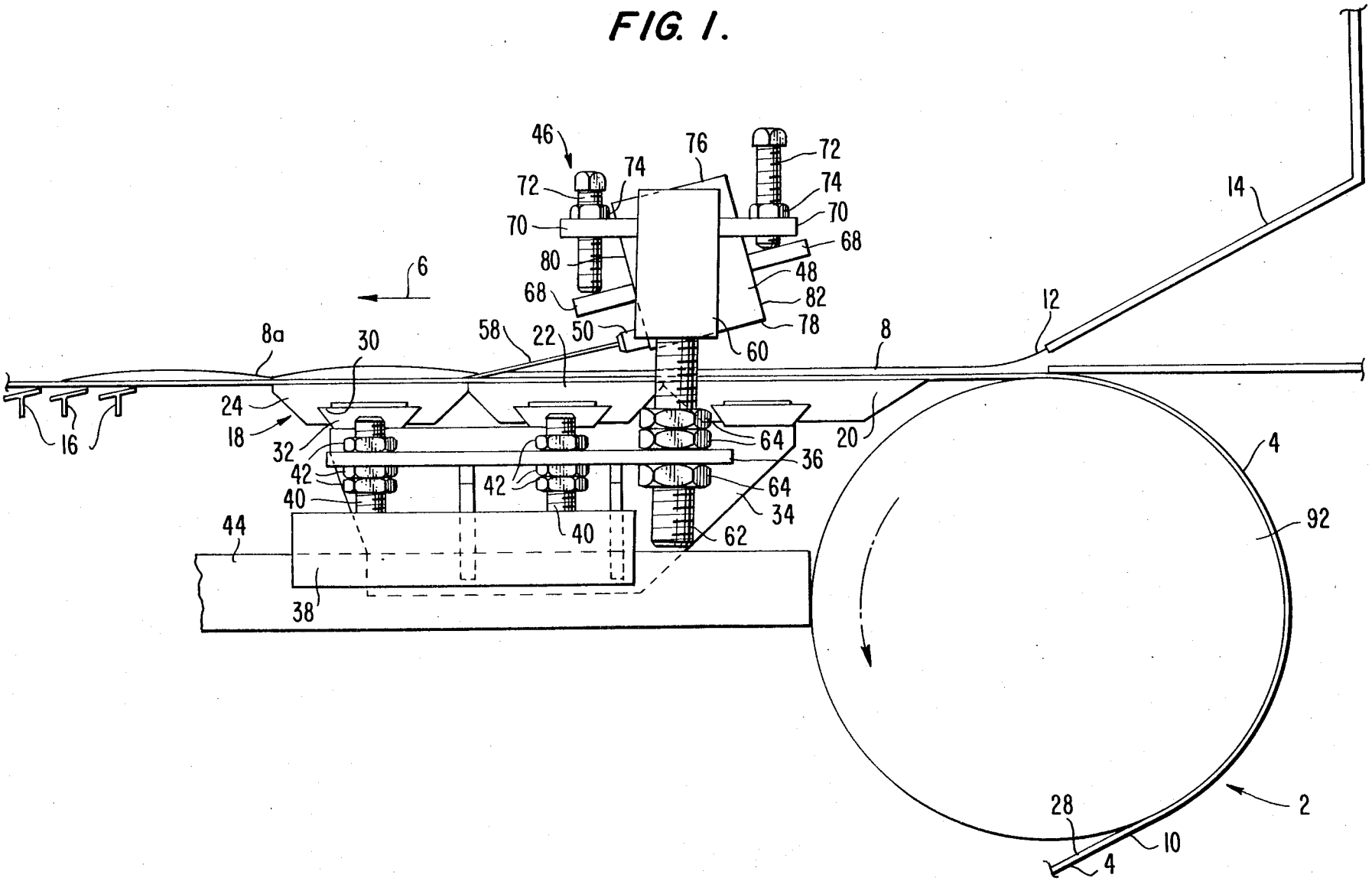
FIG. 1 is a side view of one embodiment of the present invention.
Figure 2:
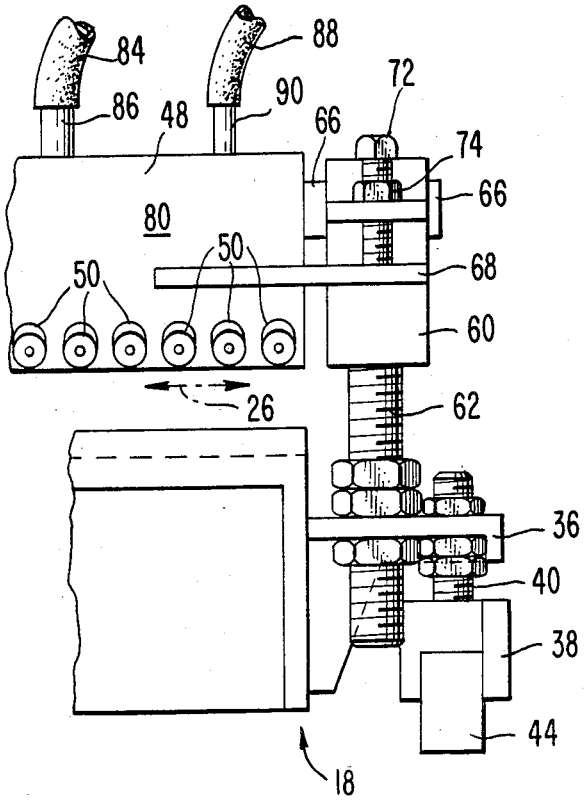
FIG. 2 is a partial front view of the embodiment depicted in FIG. 1.
Figure 3:
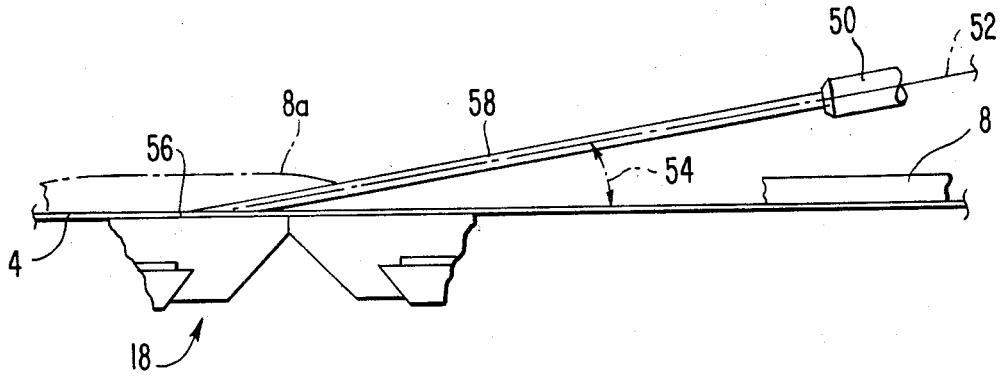
FIG. 3 is an enlarged view of a portion of FIG. 1.

The embodiment of this invention which is illustrated in FIGS. 1 to 3 is particularly suited for achieving the objects of this invention. FIG. 1 depicts a portion of the forming section of a papermaking machine 2 including an endless forming medium 4 travelling in a machine direction designated by arrow 6. Forming medium 4 is shown carrying stock 8 which has been deposited on one surface 10 of the forming medium from a slice 12 of headbox 14. A plurality of dewatering elements such as hydrofoil blades 16 are provided downstream of the slice 12.

Referring to FIGS. 1 and 2, a non-dewatering forming board 18 is provided. The forming board includes a first blade 20 and at least one other succeeding blade such as blades 22 and 24. Each of the forming blades extend in a cross machine direction designated in FIG. 2 by arrow 26, the cross machine direction being a direction transverse to the machine direction. The blades are positioned adjacent a second surface 28 of the forming medium 4, the second surface being opposite surface 10. Each of the succeeding blades 22 and 24 is downstream of the first blade 20. In the embodiment depicted in FIG. 1, the forming board 18 includes blades 20, 22 and 24 and is positioned between the slice 12 and the dewatering elements 16.

Forming blades 20, 22 and 24 are coupled to the papermaking machine in a known manner. For example, each blade includes a dovetail recess 30 which allows the blade to be slid into place beneath the forming medium 4 upon a mating dovetail 32 which extends in the cross machine direction. The dovetail 32 is attached to a support 34 in a known manner. Support 34 includes a flange 36 to which is attached a sliding member 38 by means of bolts 40 which extend through apertures in the flange 36, and nuts 42. Vertical adjustment of the forming blades can be effected by means of adjusting nuts 42 at the desired height. The forming blades can be positioned as desired in the machine direction by moving sliding member 38 along machine rail 44 in a known manner.

Forming blades 20, 22 and 24 are contiguous relative to each other by which is meant that leading and trailing edges of adjacent of the blades are in contact. Put another way, no open space is provided between adjacent blades. In this manner, the surface of the blades engaging the surface 28 of forming medium 4 provides a substantially continuous undersurface to the forming medium so that there will be no dewatering of the stock as the stock is carried over the forming board by the forming medium. To further prevent any dewatering by the forming blades, flat blades of the type well known in the art should be used.

Associated with the non-dewatering forming board 18 are means for showering the stock in a preferred manner as described herein. For example, shower apparatus 46 is depicted in FIGS. 1 and 2. Shower apparatus 46 includes a hollow shower member 48 which extends in a cross machine direction adjacent surface 10 of the forming medium 4. Shower member 48 includes a plurality of closely spaced zero degree nozzles 50 extending in the cross machine direction as shown in FIG. 2. Each nozzle 50 extends from the shower member 48 in a downstream direction in such a manner that a longitudinal axis 52 of each nozzle forms a small acute angle 54 with the upper surface 56 of the forming board 18. In the preferred embodiment, acute angle 54 is in the range of 0° to 30°. Without limitation, nozzles 50 are also positioned in close proximity with the surface 56 of forming board 18, the fluid emitting end of each nozzle 50 preferably being in the range of one to three inches from surface 56. In this manner, stock being carried by the forming medium 4 can be showered with a plurality of needle jets of water 58, each jet having a longitudinal axis coextensive with axis 52 of the nozzle from which the jet is emitted. The needle jets of water 58 are spaced along the showering member 48 in the cross machine direction, each of the needle jets of water 58 extending in a downstream direction, forming a small acute angle 54 with the stock 8, and being in close proximity with the stock so that the needle jets of water impinge upon the stock as continuous needle-like streams at a position where the stock is carried over the forming board 18 by the forming medium 4.

The term "needle jets of water" refers to the discharge from the shower means of continuous jets of water which do not break up before impinging upon the stock. A needle jet of water is to be distinguished from water which is sprayed upon the stock or a form of a jet of water which is allowed to break up into drops of water before impinging upon the stock. The water jets of the present invention are needle-like in configuration, water which is sprayed or otherwise ejected from a shower means in the form of a cone being entirely unsuitable for the objects of this invention. Without limitation, one way of producing needle jets of water is by means of zero degree nozzles sold by Spraying Systems Company of Wheaton, Illinois. Such nozzles are identified as zero degree solid stream nozzles having a 3/64 nominal inch orifice diameter sold under the trademark VeeJet.

In the embodiment depicted in the drawings, the shower apparatus 46 is coupled to the papermaking machine. For example, as depicted in FIGS. 1 and 2, shower member 48 is coupled to flange 36. To this end, a mounting stand 60 is provided having a threaded member 62 which extends through an aperture in flange 36. Nuts 64 are threaded upon member 62 so that vertical adjustment of the mounting stand can be effected by means of adjusting the nuts at the desired height. Shower member 48 is pivotally journalled to mounting stand 60 at the pivot member 66. Plates 68 extend from the shower member 48 and plates 70 extend from the mountihg stand 60. The angular orientation of the shower member 48 is effected by means of set screws 72 which are threaded through apertures in plates 70 and bear against corresponding plates 68. Adjustment of screws 72 causes shower member 48 to rotate about pivot member 66 as desired, the shower member being subsequently held in place by the set screws and their associated nuts 74.

It should be understood that a separate machine rail 44 extends in the machine direction on both sides of the papermaking machine. In a like manner, a sliding member 38, and the various apparatus described herein coupled to the sliding member 38 for supporting the forming board 18 and shower apparatus 46, are provided at both sides of the papermaking machine to provide adequate support for the forming board and shower apparatus.

In the preferred embodiment, the showering member 48 has a rectangular configuration in a cross-section taken in the machine direction as viewed in FIG. 1. In particular, the showering member includes two spaced parallel short sides 76 and 78 which extend substantially in the machine direction. Short side 78 is in close proximity to the stock. Sides 76 and 78 are joined by corresponding long sides 80 and 82, long side 80 being furtherest downstream of the slice and including a plurality of spaced water jet apertures such as, for example, zero degree nozzles 50 which extend in the cross machine direction adjacent short side 78.

Water is supplied to the shower member 48 for emission through nozzles 50 by means of one or more supply hoses 84 and inlets 86. In order to accommodate any water overflow that may exist, one or more overflow hoses 88 and outlets 90 are provided. In order to simplify the drawings this structure is only shown in FIG. 2.

In operation, an endless forming medium 4 is driven in a known manner in the machine direction 6 about a couch roll, not shown, and breast roll 92. Stock 8 is deposited from headbox 14 and through slice 12 onto the forming medium 4 where the forming medium is travelling over the non-dewatering forming board 18. As the stock is carried by the forming medium, the stock is showered with a plurality of needle jets of water 58 spaced in the cross machine direction, as a needle jet of water is emitted from each nozzle 50. Preferably, the horizontal component of the velocity of the plurality of the needle jets of water is substantially equal to the velocity of the forming medium. Each needle jet of water 58 extends in a down stream direction from a nozzle 50 towards the forming board 18, forms a predetermined acute angle 54 with the stock, and is in close proximity with the stock. Such parameters provide showering means which operate so that the needle jets of water gently impinge upon the stock as continuous closely spaced streams at a position where the stock is carried over the forming board by the forming medium. The result of this operation is to provide a uniform flow pattern in the stock. In particular, after the stock has been deposited upon the forming medium most of the flow disturbances in the stock are first allowed to die out or dissipate upon the forming board as the stock is carried over the forming board towards the needle-like showers. The stock is then showered to provide a pattern in the form of ridges **8*a*** which extend in the machine direction and are closely spaced in the cross machine direction. In providing such a pattern in the stock, it is deflocculated prior to the dewatering process which does not begin until the stock is carried off of the forming board. In providing the specifically identified needle jets of water which gently impinge upon the stock in a continuous manner, the deflocculation takes place in the absence of the any appreciable stock jump.

In the preferred embodiment, it is desired to prevent dewatering while the stock travels down the forming board. However, in some instances it may be desirable to deposit the stock 8 from the slice 12 onto the surface 10 so that its back edge lands in the wire just ahead of the point where the first blade 20 initially contacts the opposite surface 28. In this way, a small amount of water, such as one to ten per cent, is removed through the forming medium 4 to prevent the entrapment of air between the stock 8 and the top surface 10 of the forming medium 4.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. In a papermaking machine including an endless forming medium travelling in a machine direction carrying stock deposited on one surface thereof from a slice of a headbox and including a plurality of dewatering elements downstream of said slice, the improvement comprising:

(a) means for forming a substantially continuous undersurface to the forming medium to prevent the drawing of water through the forming medium and to allow substantial dissipation of flow disturbances of the stock, including a first blade and at least one other contiguous succeeding blade extending in a cross machine direction adjacent a second surface of said forming medium opposite said one surface, each of said contiguous succeeding blades being downstream of said first blade, said means being positioned between said slice and said dewatering elements; and, (b) means extending in a cross machine direction adjacent said one surface of said forming medium for showering said stock with a plurality of needle jets of water spaced along said showering means in the cross machine direction, each of said needle jets of water extending in a downstream direction, forming a small acute angle with said stock, and being in close proximity with said stock so that said needle jets of water gently impinge upon said stock as continuous streams at a position where said flow disturbance have substantially dissipated and as said stock on said forming medium is being carried over said forming means by said forming medium so as to form a uniform flow pattern in said stock.

2. The papermaking machine of claim 1 wherein said showering means includes a shower member comprising a plurality of closely spaced zero degree nozzles spaced along said shower member in the cross machine direction, each of said nozzles emitting one of said needle jets of water.

3. The papermaking machine of claim 1 wherein said showering means includes a shower member which has a rectangular configuration in a cross-section taken in the machine direction and includes two spaced parallel short sides which extend substantially in said machine direction, one of said short sides being in close proximity to said stock, said sides being joined by corresponding long sides, one long side furtherest downstream of said slice including a plurality of spaced water jet apertures extending in the cross machine direction adjacent said one short side, each of said apertures emitting one of said needle jets of water.

4. The papermaking machine of claim 3 wherein said apertures comprise zero degree nozzles.

5. The papermaking machine of claim 2 wherein each of said nozzles extend in a downstream direction, have a longitudinal axis which forms an acute angle with said stock, and is in close proximity with said stock.

6. The papermaking machine of claim 4 wherein each of said nozzles extend in a downstream direction, have a longitudinal axis which forms an acute angle with said stock, and is in close proximity with said stock.

7. The papermaking machine of claim 1 wherein said acute angle has a range of 0° to 30°.

8. The papermaking machine of claim 2 wherein said acute angle has a range of 0° to 30°.

9. The papermaking machine of claim 3 wherein said acute angle has a range of 0° to 30°.

10. The papermaking machine of claim 5 wherein said acute angle has a range of 0° to 30°.

11. The papermaking machine of claim 6 wherein said acute angle has a range of 0° to 30°.

12. In a method of making paper on a papermaking machine including an endless forming medium travelling in a machine direction comprising the steps of:

(a) depositing stock from a headbox, through a slice and onto said forming medium wherein said forming medium travels over a continuous surfaced non-dewatering forming board;

(b) carrying said stock on said forming medium over said forming board such that the drawing of water through said forming medium is prevented and allowing substantial dissipation of flow disturbances in the stock upon said forming medium over said forming board forming board; and, (c) showering said stock with a plurality of needle jets of water spaced in the cross machine direction as said stock is carried on said forming medium over said forming board, said needle jets of water extending in a downstream direction, forming an acute angle with said stock and being in close proximity with said stock, said needle jets of water gently impinging upon said stock, where flow disturbances in said stock has been substantially dissipated, as continuous streams and forming a uniform flow pattern in said stock.

13. The method of claim 12 wherein said acute angle has a range of 0° to 30°.

14. The method of claim 13 wherein the velocity of a plurality of said needle jets of water is substantially equal to the velocity of said forming medium.

* * * * *